US010039954B1

(12) United States Patent
Tung

(10) Patent No.: US 10,039,954 B1
(45) Date of Patent: Aug. 7, 2018

(54) SPINNING BIKE WITH SWINGABLE STRUCTURE

(71) Applicant: SINGULARITY LTD., Belize (BZ)

(72) Inventor: Chia Lin Tung, Taichung (TW)

(73) Assignee: BH Asia Hong Kong Holding Co., Limited, Taichung (TW)

( * ) Notice: Subject to any disclaimer, the term of this patent is extended or adjusted under 35 U.S.C. 154(b) by 0 days.

(21) Appl. No.: 15/586,641

(22) Filed: May 4, 2017

(51) Int. Cl.
*A63B 22/06* (2006.01)

(52) U.S. Cl.
CPC .. *A63B 22/0605* (2013.01); *A63B 2022/0641* (2013.01)

(58) Field of Classification Search
CPC ..... A63B 22/0605–2022/0658; A63B 26/003; A63B 22/16
See application file for complete search history.

(56) References Cited

U.S. PATENT DOCUMENTS 6,126,577 A * 10/2000 Chang ..... A63B 26/003 434/61
6,322,480 B1 * 11/2001 Lim ..... A63B 26/003 472/103
2002/0055422 A1 * 5/2002 Airmet ..... A63B 22/16 482/61
2015/0111704 A1 * 4/2015 Lin ..... A63B 22/0605 482/57
2015/0238808 A1 * 8/2015 Lin ..... A63B 22/0605 482/57
2016/0287931 A1 * 10/2016 Tung ..... A63B 22/16

* cited by examiner

*Primary Examiner* — Jennifer M Deichl
(74) *Attorney, Agent, or Firm* — Rosenberg, Klein & Lee

(57) ABSTRACT

A spinning bike with swingable structure includes a frame, a base member, and a limiting assembly. A mount of the limiting assembly is disposed on the frame, and two supporting bars of the limiting assembly are disposed at two sides of the mount and standing vertically. An adjustable member is adapted to adjust the two supporting bars to move downwardly until bottom ends of the supporting bars are in contact with the base member, so that the frame is not swingable with respect to the base member. Alternatively, the adjustable member adjusts the two supporting bars to move upwardly until the bottom ends are not in contact with the base member, so that the frame is swingable with respect to the base member.

5 Claims, 6 Drawing Sheets

SPINNING BIKE WITH SWINGABLE STRUCTURE

BACKGROUND OF THE INVENTION

Field of the Invention

The present invention relates to a spinning bike, in particular to a spinning bike with a swingable structure.

Description of the Prior Art

Spinning bikes is training equipment allowing a user to act as if he or she goes bicycling. In a conventional, the mount of the spinning bike is fixedly positioned at a certain location via a frame, so that the user can tread on the pedal of the bike for training, as if he or she goes bicycling. However, because the frame is fixed, the whole mount of the spinning bike is fixed, except the pedals. As a result, when the user rides on the spinning bike, the user eventually cannot have the feeling as if he or she goes bicycling. Consequently, the user may feel bored during the training.

Hence, a conventional swingable spinning bike is developed, as mentioned in Taiwan patent TWM471910. In this case, the mount is pivoted on a base member. Therefore, during the training, the mount can be tilted with respect to the base member when the user swings laterally. Accordingly, when the user rides on the spinning bike, the conventional swingable spinning bike allows the user to have the feeling as if he or she goes bicycling, thereby improving the interest for the training.

Nevertheless, the aforementioned two spinning bikes have advantages, respectively, and the bikes provide different training performances. One of the two spinning bikes cannot have the advantages of the other. As a result, sports centers have to purchase both the two different spinning bikes to meet different user requirements and preference, thereby increasing the cost.

SUMMARY OF THE INVENTION

One object of the present invention is to solve the aforementioned problem and to provide a spinning bike with swingable structure. Therefore, the frame of spinning bike can have laterally swingable and fixed configurations.

In view of these objects, the spinning bike with swingable structure comprises:

- a frame, a bottom portion of the frame having a first pivot;
- a base member having a second pivot holder, a position of the second pivot holder corresponding to a position of the first pivot holder, wherein the first pivot holder of the frame is pivoted with the second pivot holder of the base member, so that the frame is swingable laterally with respect to the base member;
- two elastic members located at two sides of the second pivot holder and disposed on the base member, wherein the first pivot holder of the frame is supported by the two elastic members and kept standing, one corresponding elastic member of the elastic members is compressed and deformed to support the first pivot holder when the frame is laterally swung with respect to the base member;
- a limiting assembly, having a body, two supporting bars, and an adjustable member, wherein the mount is located above the first pivot holder and disposed on the frame, wherein the mount is laid laterally when the frame is standing, two ends of the mount extend toward the two sides of the second pivot holder having the two elastic members, the two supporting bars are disposed at two sides of the mount and standing vertically, the adjustable member is connected to the two supporting bars to adjust the two supporting bars to move downwardly to allow bottom ends of the supporting bars to be in contact with the base member or to move upwardly to allow the bottom ends of the supporting bars not to be in contact with the base member.

In one embodiment, the adjustable member is a screw located above the first pivot holder, disposed on the frame, and rotatable freely, the mount is a plate having a screw hole at a center thereof for threading with the screw, the first pivot holder has two limiting holes for inserting the supporting bars, the adjustable member is rotated to drive the two supporting bars and the mount to move upwardly or downwardly.

In one embodiment, each of the supporting bars has a pivot portion and a blocking member at one end thereof, the pivot portion has a first shaft hole defined through the supporting bar in a radial direction of the supporting bar, the blocking member has a protruding portion at one of two ends thereof, the bottom end is at the other end of the blocking member, the protruding portion has a second shaft hole, the protruding portion is placed in the pivot portion and the first shaft hole is aligned with the second shaft hole, a shaft member passes through the second shaft hole of the blocking member and the first shaft hole of the pivot portion, so that the blocking member is pivoted on the pivot portion, and the blocking member is pivotable with respect to the pivot portion in an axial direction of the shaft member to tweak a distance between the bottom end of the supporting bar and the base member.

In one embodiment, the elastic members are compression springs or polyurethane sticks.

In one embodiment, each of the elastic members has two fixed nuts on two ends thereof, two bolts respectively pass through the base member and the first pivot holder at the two elastic members, so that positions of the two elastic members between the base member and the first pivot holder is positioned.

DETAILED DESCRIPTION OF THE PREFERRED EMBODIMENTS

Please refer to FIGS. 1 to 6, illustrating a spinning bike with swingable structure. FIGS. 1 to 6 are for illustrative purpose, not limitations to the present invention.

Figure 1:
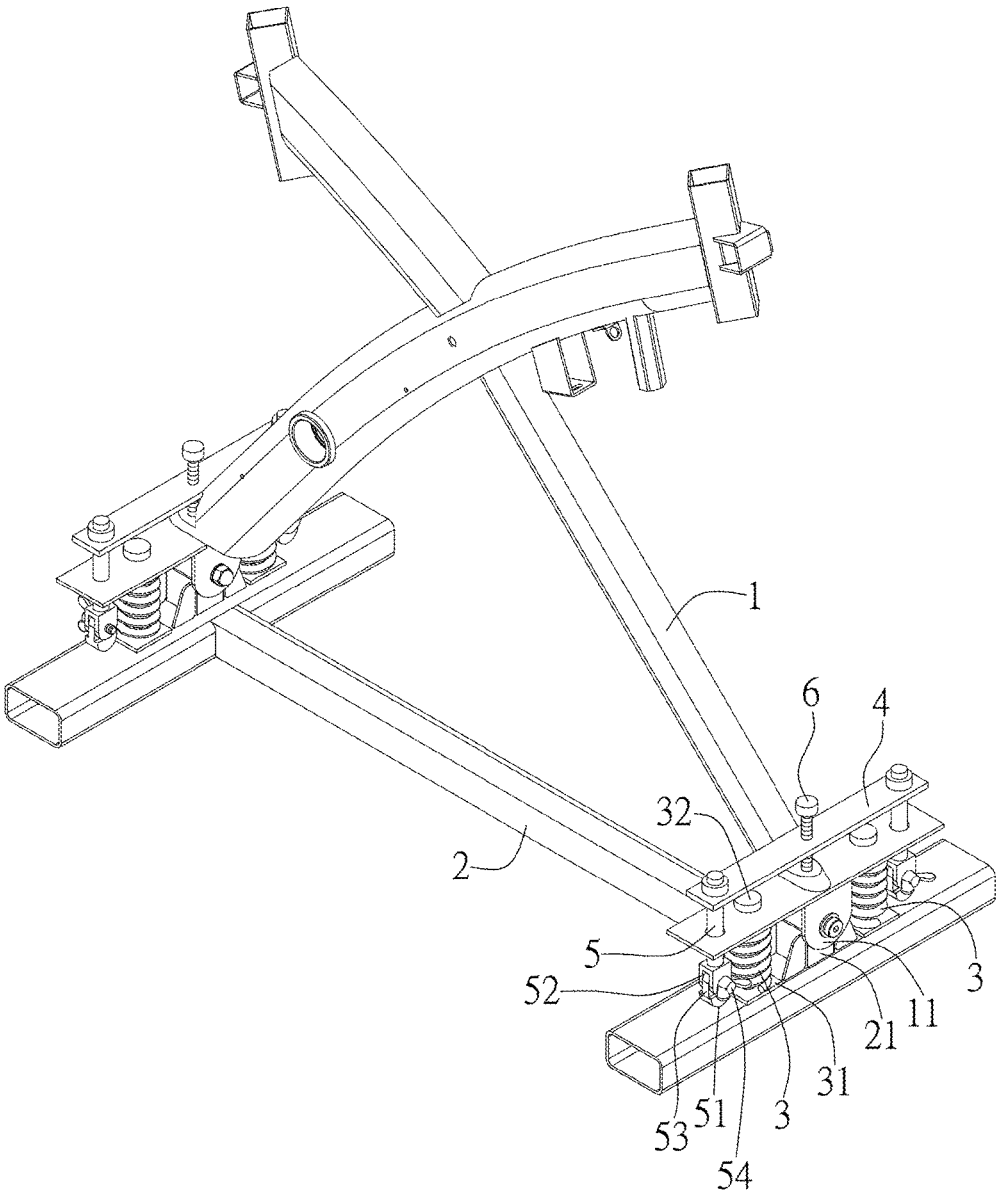
FIG. 1 illustrates a perspective view of the spinning bike showing that the frame is assembled on a base member, according to an exemplary embodiment of the present invention.

In the present invention, a spinning bike with swingable structure is provided, as shown in FIG. 1, the spinning bike comprises a frame 1, a base member 2, several elastic members 3, and limiting assemblies.

As shown in FIG. 1, the bottom portion of the frame 1 has two first pivot holders 11, the two first pivot holders 11 are respectively at the front portion of the frame 1 and the rear portion of the frame 1. The first pivot holder 11 is approximately in T shape. The base member 2 is in I shaped and laid. The base member 2 has second pivot holders 21, and the positions of the second pivot holders 21 correspond to the positions of the first pivot holders 11. The first pivot holders 11 of the frame 1 are respectively pivoted with the second pivot holders 21 of the base member 2, so that the frame 1 is swingable laterally with respect to the base member 2. In other words, a user can ride on the frame 1 and allow the frame 1 to tilt rightward or leftward, with respect to the base member 2.

Figure 2:
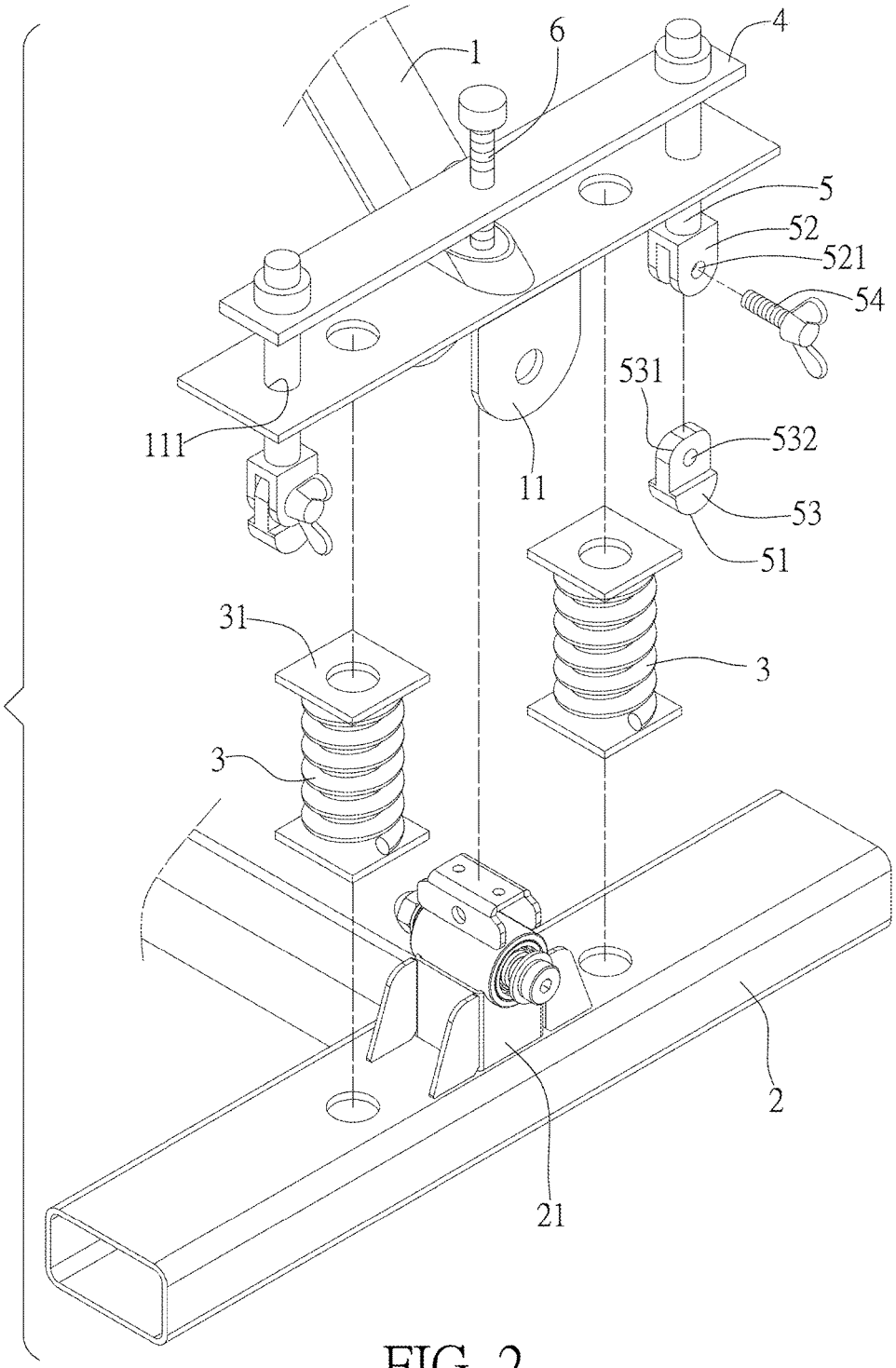
FIG. 2 illustrates an exploded view of the spinning bike showing that the limiting assembly is assembled between the frame and the base member.
Figure 3:
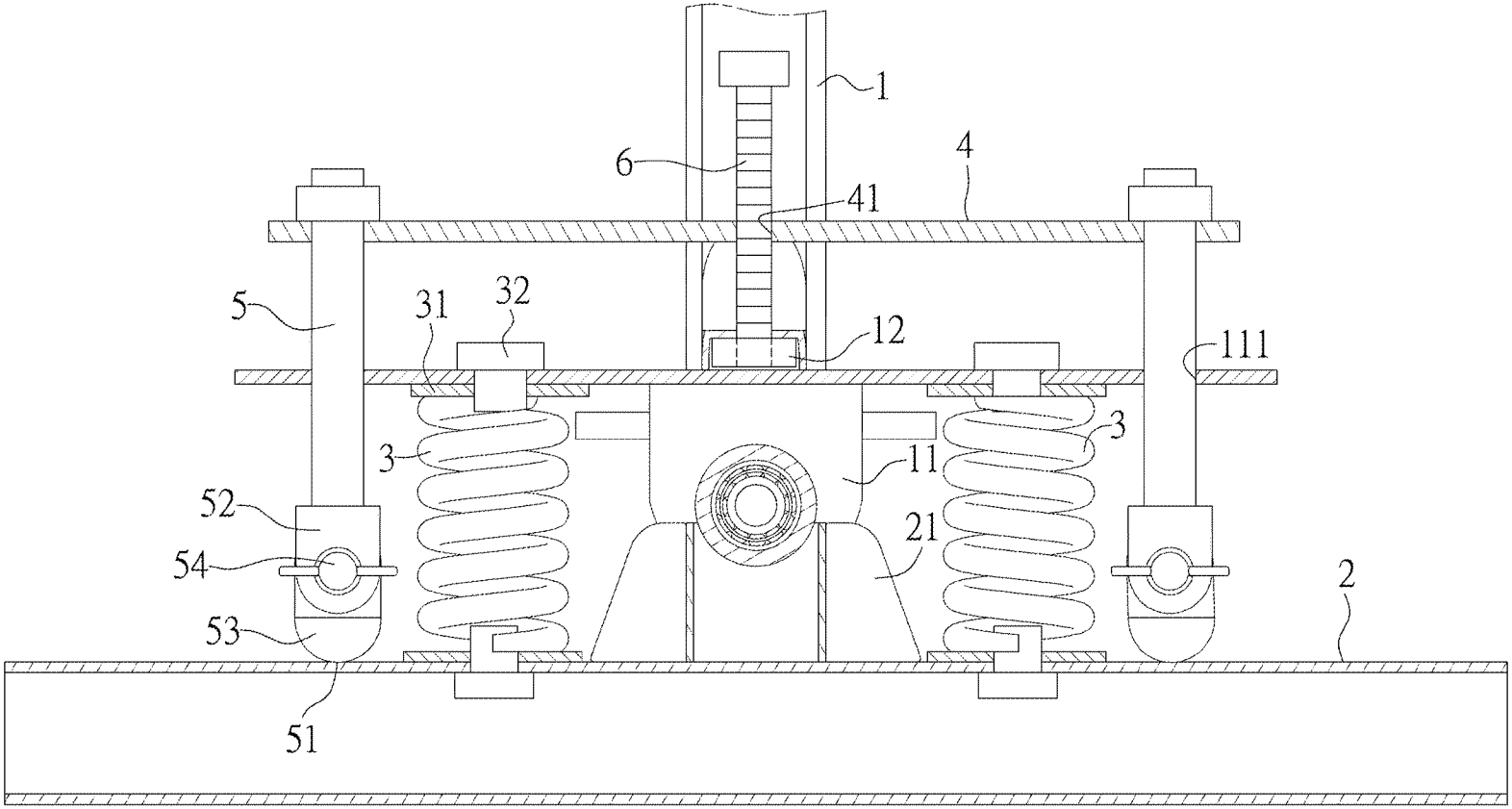
FIG. 3 illustrates a sectional view of the spinning bike showing that the limiting assembly is assembled between the frame and the base member.

As shown in FIGS. 2 and 3, the elastic members 3 are located at two sides of each of the second pivot holders 21 and disposed on the base member 2. Each of the first pivot holders 11 of the frame 1 is supported by two of the elastic members 3, and the frame 1 is not tilted and kept standing. When the frame 1 is laterally swung with respect to the base member 2, one of the elastic members 3 is compressed by the first pivot holder 11 and deformed, so that a resilient force of the elastic member 3 supports the first pivot holder 11 to prevent the frame 1 from falling down toward the tilt direction. In this embodiment, the elastic members 3 are compression springs. Two ends of each of the elastic members 3 respectively have fixed nuts 31. Bolts 32 respectively pass through the base member 2 and the first pivot holder 11 at the two elastic members 3, and the bolts 32 respectively thread with the nuts 31, so that the positions of the elastic members 3 between the base member 2 and the first pivot holder 11 is positioned.

As shown in FIGS. 2 and 3, each of the limiting assemblies has a mount 4, two supporting bars 5, and an adjustable member 6. The mount 4 is located above the first pivot holder 11 and disposed on the frame 1. The mount 4 is laid laterally when the frame 1 is standing. Two ends of the mount 4 extend toward the two sides of the second pivot holder 21 having the two elastic members 3. The two supporting bars 5 are disposed at two sides of the mount 4 and standing vertically. The adjustable member 6 is connected to the two supporting bars 5 to adjust the two supporting bars 5 to move downwardly to allow bottom ends 51 of the supporting bars 5 to be in contact with the base member 2 or to move upwardly to allow the bottom ends 51 of the supporting bar 5 not to be in contact with the base member 2.

As shown in FIGS. 2 and 3, in this embodiment, the adjustable member 6 is a screw located above the first pivot holder 11 and disposed on the frame 1. Here, the end of the adjustable member 6 is connected to a bearing 12 in the frame 1 so that the adjustable member 6 is rotatable freely. The mount 4 is a plate having a screw hole 41 at a center thereof. The screw hole 41 of the mount 4 is threaded with the adjustable member 6. When the adjustable member 6 is rotated, the mount 4 is threaded with the adjustable member 6 along with the screw hole 41 so as to be moved upwardly or downwardly. In this embodiment, the first pivot holder 11 has two limiting holes 111 for inserting the supporting bars 5. The adjustable member 6 is rotated to drive the supporting bars 5 and the mount 4 to move upwardly or downwardly. When the adjustable member 6 is rotated, the mount 4 threaded with the adjustable member 6 may be rotated as well. Hence, by inserting the two supporting bars 5 into the two limiting holes 111, the mount 4 is not rotated when the adjustable member 6 is rotated. Instead, when the adjustable member 6 is rotated, the mount 4 moves upwardly or downwardly in a longitudinal direction.

As shown in FIGS. 2 and 3. In this embodiment, each of the supporting bars 5 has a pivot portion 52 and a blocking member 53 at one end thereof. The pivot portion 52 has a first shaft hole 521 defined through the supporting bar 5 in a radial direction of the supporting bar 5. The blocking member 53 has a protruding portion 531 at one of two ends thereof. The bottom end 531 is at the other end of the blocking member 53. The protruding portion 531 has a second shaft hole 532. The protruding portion 531 is placed in the pivot portion 52 and the first shaft hole 521 is aligned with the second shaft hole 532. A shaft member 54 passes through the second shaft hole 532 of the blocking member 53 and the first shaft hole 521 of the pivot portion 52, so that the blocking member 53 is pivoted on the pivot portion 52, and the blocking member 53 is pivotable with respect to the pivot portion 52 in an axial direction of the shaft member 54.

As mentioned, the pivot portion 52 and the blocking member 53 allow a user to tweak a distance between the bottom ends 51 and the base member 2 after the operating height of the supporting bars 5 is adjusted, so that the tilt angle of the frame 1 can be adjusted slightly. In this embodiment, the shaft member 54 is a butterfly bolt. When the shaft member 54 is loose, the tilt angle of the blocking member 53 can be adjusted; while when the shaft member 54 is tighten, the blocking member 53 is firmly positioned with the pivot portion 52.

Figure 4:
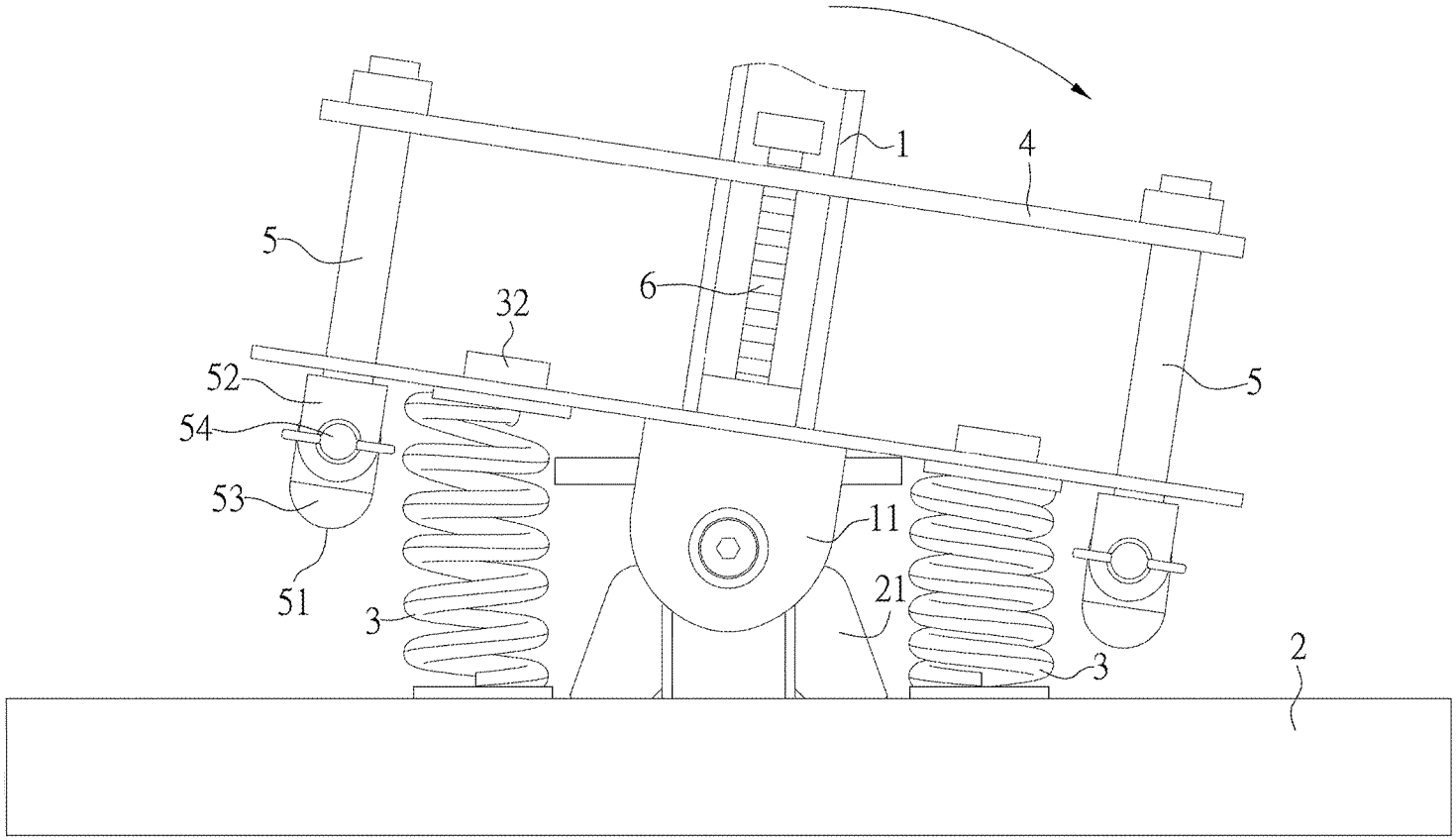
FIG. 4 illustrates a schematic view of the spinning bike showing that the elastic member is compressed to support the frame when the frame is tilted with respect to the base member.
Figure 5:
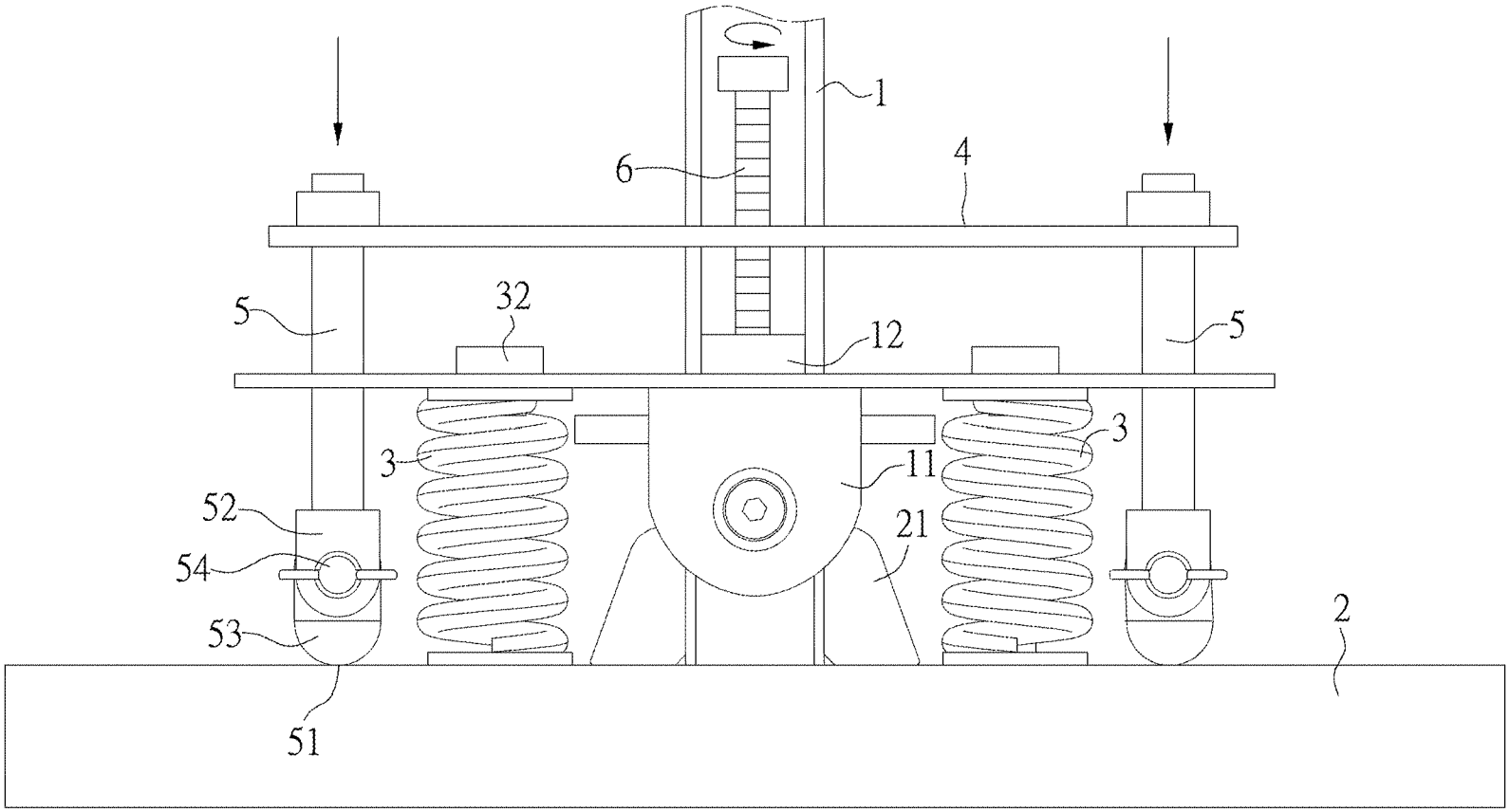
FIG. 5 illustrates a schematic view of the spinning bike showing that the bottom ends of the supporting bar of the limiting assembly supports the base member to prevent the frame being tilted with respect to the base member.

As shown in FIG. 4, when a user rides on the spinning bike with the need of tilt function, the bottom ends 51 of the supporting bars 5 are detached from the base member 2. Namely, the adjustable member 6 is rotated to move the mount 4 upwardly, so that the two supporting bars 5 are moved upwardly along with the mount 4 until a space is formed between the bottom ends 51 and the base member 2. Accordingly, the frame 1 is swingable laterally. Alternatively, as shown in FIG. 5, when the user rides on the spinning bike without the need of tilt function, the bottom ends 51 of the supporting bars 5 are in contact with the base member 2. Namely, the adjustable member 6 is rotated to move the mount 4 downwardly, so that the two supporting bars 5 are moved downward along with the mount 4 until the bottom ends 51 are in contact with the base member 2. Hence, the frame 1 is fixed and not swingable, and the frame 1 keeps standing when the user rides on the spinning bike.

Figure 6:
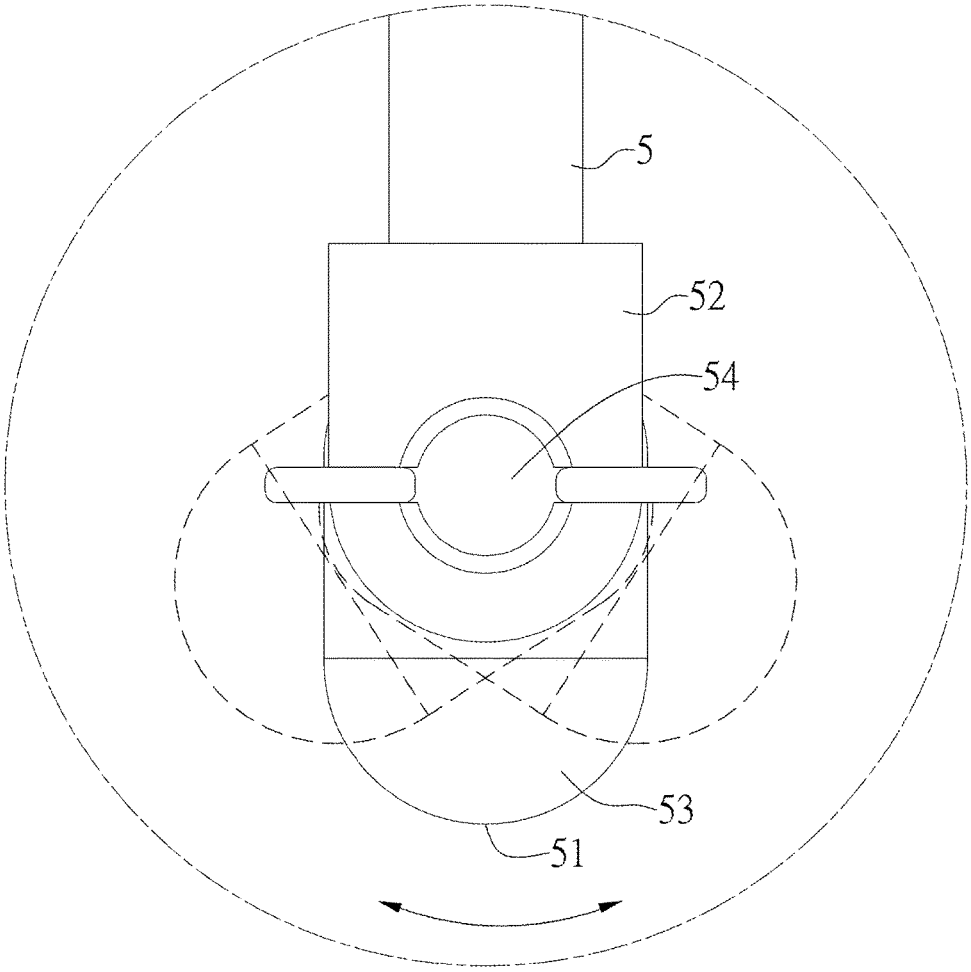
FIG. 6 illustrates a schematic view of the spinning bike showing that the blocking member of the supporting bar is pivoted relative to the pivoting portion.

To adjust the tilt angle of the frame 1, the distance between the bottom ends 51 of the supporting bars 5 and the base member 2 may be adjusted by the operation of the adjustable member 6. The longer the distance between the bottom ends 51 and the base member 2 is, the greater the tilt angle is; conversely, the shorter the distance between the bottom ends 51 and the base member 2 is, the lesser the tilt angle is. If someone tends to tweak the distance between the bottom ends 51 and the base member 2, as shown in FIG. 6, the pivot angle of the blocking member 53 of the supporting bar 5 can be adjusted, so that the distance between the bottom ends 51 and the base member 2 can be tweaked according to the orientation of the blocking member 53.

As above, the present invention has following advantages. The limiting assembly allows the frame 1 of the spinning bike to be laterally swingable or fixed. When the bottom ends 51 of the supporting bars 5 are not in contact with the base member 2, the frame 1 of the spinning bike is laterally swingable. Conversely, when the adjustable member 6 is adjusted so that the supporting bars 5 are moved downwardly and the bottom ends 51 of the supporting bars 5 are in contact with the base member 2, the frame 1 is supported by the supporting bars 5 and fixed. Hence, the frame 1 of the spinning bike can have swingable and fixed configuration.

What is claimed is:

1. A spinning bike with swingable structure, comprising:

a frame, a bottom portion of the frame having a first pivot holder;

a base member having a second pivot holder, a position of the second pivot holder corresponding to a position of the first pivot holder, wherein the first pivot holder of the frame is pivoted with the second pivot holder of the base member, so that the frame is swingable laterally with respect to the base member;

two elastic members located at two sides of the second pivot holder and disposed on the base member, wherein the first pivot holder of the frame is supported by the two elastic members and kept standing, one corresponding elastic member of the elastic members is compressed and deformed to support the first pivot holder when the frame is laterally swung with respect to the base member;

a limiting assembly, having a mount, two supporting bars, and an adjustable member, wherein the mount is located above the first pivot holder and disposed on the frame, wherein the mount is laid laterally when the frame is standing, two ends of the mount extend toward the two sides of the second pivot holder having the two elastic members, the two supporting bars are disposed at two sides of the mount and standing vertically, the adjustable member is connected to the two supporting bars to adjust the two supporting bars to move downwardly to allow bottom ends of the supporting bars to be in contact with the base member or to move upwardly to allow the bottom ends of the supporting bars not to be in contact with the base member.

2. The spinning bike with swingable structure according to claim 1, wherein the adjustable member is a screw located above the first pivot holder, disposed on the frame, and rotatable freely, the mount is a plate having a screw hole at a center thereof for threading with the screw, the first pivot holder has two limiting holes for inserting the supporting bars, the adjustable member is rotated to drive the two supporting bars and the mount to move upwardly or downwardly.

3. The spinning bike with swingable structure according to claim 2, wherein each of the supporting bars has a pivot portion and a blocking member at one end thereof, the pivot portion has a first shaft hole defined through the supporting bar in a radial direction of the supporting bar, the blocking member has a protruding portion at one of two ends thereof, and a bottom end is at the other end of the blocking member, the protruding portion has a second shaft hole, the protruding portion is placed in the pivot portion and the first shaft hole is aligned with the second shaft hole, a shaft member passes through the second shaft hole of the blocking member and the first shaft hole of the pivot portion, so that the blocking member is pivoted on the pivot portion, and the blocking member is pivotable with respect to the pivot portion in an axial direction of the shaft member to tweak a distance between the bottom end of the supporting bar and the base member.

4. The spinning bike with swingable structure according to claim 1, wherein the elastic members are compression springs or polyurethane sticks.

5. The spinning bike with swingable structure according to claim 4, wherein each of the elastic members has two fixed nuts on two ends thereof, two bolts respectively pass through the base member and the first pivot holder at the two elastic members, so that positions of the two elastic members between the base member and the first pivot holder are positioned.

* * * * *